US010165856B2

(12) United States Patent
Gleixner et al.

(10) Patent No.: US 10,165,856 B2
(45) Date of Patent: Jan. 1, 2019

(54) HOUSEHOLD APPLIANCE

(71) Applicant: BSH Hausgeräte GmbH, Munich (DE)

(72) Inventors: Marco Gleixner, Bachhagel (DE); Franz Kiechle, Günzburg (DE); Reinhold Lader, Altenmünster (DE)

(73) Assignee: BSH Hausgeräte GmbH, Munich (DE)

( * ) Notice: Subject to any disclaimer, the term of this patent is extended or adjusted under 35 U.S.C. 154(b) by 137 days.

(21) Appl. No.: 15/033,660

(22) PCT Filed: Nov. 4, 2014

(86) PCT No.: PCT/EP2014/073682
§ 371 (c)(1),
(2) Date: May 2, 2016

(87) PCT Pub. No.: WO2015/067596
PCT Pub. Date: May 14, 2015

(65) Prior Publication Data

US 2016/0270532 A1 Sep. 22, 2016

(30) Foreign Application Priority Data

Nov. 6, 2013 (DE) ..... 10 2013 222 576

(51) Int. Cl.

| | |
|---|---|
| ***A47L 15/50*** | (2006.01) |
| ***A47B 88/467*** | (2017.01) |
| ***A47B 88/04*** | (2006.01) |
| *A47B 88/40* | (2017.01) |

(52) U.S. Cl.
CPC ..... *A47B 88/047* (2013.01); *A47B 88/467* (2017.01); *A47L 15/501* (2013.01); *A47L 15/502* (2013.01); *A47L 15/507* (2013.01); *A47B 2088/401* (2017.01)

(58) Field of Classification Search
CPC .. A47B 88/467; A47L 15/0084; A47L 15/507
See application file for complete search history.

(56) References Cited

U.S. PATENT DOCUMENTS 3,154,281 A * 10/1964 Frank ..... F16B 21/06 174/138 G
7,258,126 B2 8/2007 Shinchi et al.
8,894,166 B2 11/2014 Laible
(Continued)

FOREIGN PATENT DOCUMENTS

CN 1498585 A 5/2004
CN 2634925 Y 8/2004
(Continued)

OTHER PUBLICATIONS

National Search Report CN 201480057512X dated Apr. 26, 2017.
(Continued)

*Primary Examiner* — David G Cormier
(74) *Attorney, Agent, or Firm* — Michael E. Tschupp; Andre Pallapies; Brandon G. Braun

(57) ABSTRACT

A household appliance includes a loading level, and a receiving area for receiving the loading level. A guide device guides the loading level when the loading level is selectively displaced into or out of the receiving area along the guide device. Secured to the guide device is a retraction device for automatically displacing the loading level into the receiving area.

12 Claims, 8 Drawing Sheets

(56) References Cited

U.S. PATENT DOCUMENTS

| | | | | |
|---|---|---|---|---|
| 8,905,497 | B2 | 12/2014 | Bantle | |
| 8,905,498 | B2 | 12/2014 | Hammerle | |
| 2004/0056573 | A1* | 3/2004 | Chae | F25D 25/025 312/404 |
| 2009/0140621 | A1* | 6/2009 | Yang | A47B 88/467 312/319.1 |
| 2010/0231107 | A1* | 9/2010 | Radusin | A47B 88/047 312/319.1 |
| 2012/0118330 | A1* | 5/2012 | Tuller | A47L 15/0047 134/25.2 |

FOREIGN PATENT DOCUMENTS

| | | | |
|---|---|---|---|
| CN | 103209613 | A | 7/2013 |
| DE | 202004005322 | U1 | 3/2005 |
| DE | 202006006188 | U1 | 8/2007 |
| DE | 102011005257 | A1 | 9/2012 |
| EP | 2140782 | B1 | 10/2011 |
| EP | 2538144 | A1 | 12/2012 |
| EP | 1931231 | B1 | 6/2017 |

OTHER PUBLICATIONS

Report of Examination DE 10 2013 222 576.8 dated Jul. 11, 2014.
International Search Report PCT/EP2014/073682 dated Feb. 17, 2014.

* cited by examiner

HOUSEHOLD APPLIANCE

CROSS-REFERENCES TO RELATED APPLICATIONS

This application is the U.S. National Stage of International Application No. PCT/EP2014/073682, filed Nov. 4, 2014, which designated the United States and has been published as International Publication No. WO 2015/067596 and which claims the priority of German Patent Application, Serial No. 10 2013 222 576.8, filed Nov. 6, 2013, pursuant to 35 U.S.C. 119(*a*)-(*d*).

BACKGROUND OF THE INVENTION

The present invention relates to a household appliance. The household appliance is in particular a dishwasher.

A dishwasher has a dishwasher cavity and at least one loading level which can be displaced into or out of the dishwasher cavity. For instance, the loading level may be a receptacle for items to be washed such as a top basket, a bottom basket or a cutlery drawer. The at least one loading level can be moved along a guide device provided in the dishwasher cavity. The guide device can be a guide rail for instance. The dishwasher may have a number of such loading levels.

DE 10 2011 005 257 A1 discloses a dishwasher having a retraction device for automatically retracting a receptacle for items to be washed into the dishwasher cavity. The retraction device has a spring element and a damping element. The retraction device is fixedly or detachably mounted on a rear wall of the dishwasher cavity. The retraction device is operatively connected to the receptacle for items to be washed with the aid of a snap hook.

BRIEF SUMMARY OF THE INVENTION

Against this background, one object of the present invention consists in providing an improved household appliance.

Accordingly, a household appliance is proposed, in particular a dishwasher, with a loading level, a receiving area for receiving the loading level, a guide device for guiding the loading level, wherein the loading level can be selectively displaced along the guide device either into or out of the receiving area and a retraction device secured to the guide device for automatically displacing the loading level into the receiving area.

The household appliance is preferably a water-bearing household appliance, in particular a dishwasher. The household appliance can also be an oven, a microwave oven, a refrigerator, an upright freezer or suchlike. The retraction device is in particular not secured to the receiving area. The retraction device is preferably only secured to the guide device. The receiving area is in particular a dishwasher cavity of a dishwasher. The loading level is preferably a receptacle for items to be washed such as for instance a top basket, a bottom basket or a cutlery drawer of the dishwasher. As result of the retraction device only being secured to the guide device, assembly of the retraction device directly on the dishwasher cavity itself can be omitted. The retraction device with the guide device can be used flexibly here and easily assembled or replaced. A retraction arrangement for the household appliance may comprise the guide device and the retraction device.

According to one embodiment, the guide device comprises a first guide rail, which is assigned to the receiving area, and a second guide rail, which is assigned to the loading level. In this way the retraction device is configured to automatically displace the second guide rail along the first guide rail.

The guide device is preferably what is known as a smooth running rail. A middle guide rail which can be moved relative to the first and second guide rail is preferably provided between the first guide rail and the second guide rail. In this way, the loading level can be displaced particularly far away from the receiving area. This facilitates loading of the loading level with items to be washed for instance.

According to a further embodiment, the retraction device has a spring element, which can be prestressed when the loading level is displaced out of the receiving area.

The spring element may be a helical or cylindrical spring for instance. Furthermore, the spring element can be an elastomer element. In particular, the spring element is prestressed against a retraction direction of the loading level during manual displacement. The loading level is thus displaced out of the receiving area against a spring force of the spring element.

According to a further embodiment, the retraction device has a damping element, which is configured to dampen a movement of the loading level while automatically displacing the loading level into the receiving area.

A noise generation when the loading level is retracted into the receiving area is prevented in this way. Furthermore, the loading level is moved at a uniform speed. A uniform and smooth entry of the loading level into the receiving area is always ensured in this way.

According to a further embodiment, an activator element is provided, which is configured to engage in an engagement section of the retraction device in a form-fit manner The engagement section preferably has two gripper arms which surround the activator element in a form-fit manner The engagement section is in particular coupled to the spring element and/or the damping element.

According to a further embodiment, the activator element is secured to a first guide rail of the guide device and the retraction device is secured to a second guide rail of the guide device.

According to a further embodiment, the guide device is secured to a first guide rail of the guide device and the activator element is secured to a second guide rail of the guide device.

A securing of the retraction device to the receiving area can be omitted in this way. This allows for a flexible modular use of the retraction device, as a result of which its field of application increases. In particular, the retraction device is preassembled on the guide device.

According to a further embodiment, the retraction device, the guide device and the activator element form a retraction arrangement of the household appliance.

The retraction arrangement is preferably provided as a preassembled component, and can thus be assembled rapidly into or on the receiving area. The retraction device may comprise the activator element.

According to a further embodiment, the activator element engages into the engagement section when the loading level is displaced in a retraction direction of the same, as a result of which the retraction device can be activated such that this automatically displaces the loading level into the receiving area.

In particular, when the loading level is displaced in the retraction device so that the activator element engages in the engagement section, the spring element unlocks and the loading level automatically displaces into the receiving area with the aid of a spring force of the spring device. In this way, the damping device preferably dampens the movement of the loading level, as a result of which this is drawn into the receiving area in a particularly uniform and smooth manner According to a further embodiment, the activator element is a plastic injection molded part.

Here, the activator element can be cost-effectively manufactured in large quantities.

According to a further embodiment, the activator element can be snapped into a guide rail of the household appliance.

The activator element preferably has an elastically deformable snap hook, which is configured to engage into a corresponding cut-out of the guide rail in a form-fit manner The activator element can be assembled quickly and easily as a result.

According to a further embodiment, the activator element has a triangular geometry with a securing section and a pin-type activator section.

The fastening section preferably has a snap hook and can be secured to the guide rail. The activator section is arranged in particular on a tip of the triangular geometry. The activator section is configured to engage in the engagement section of the retraction device in a form-fit manner.

According to a further embodiment, the receiving area is a dishwasher cavity.

The dishwasher cavity can be closed in a water-tight manner particularly with the aid of a door. The household appliance is preferably a dishwasher and the receiving area is a dishwasher cavity of the dishwasher.

According to a further embodiment, the loading level is a receptacle for items to be washed.

According to a further embodiment, the household appliance has a number of receptacles for items to be washed, wherein each one of the number of receptacles for items to be washed is a bottom basket, a top basket or a cutlery drawer.

A retraction arrangement can preferably be provided on both sides of the longitudinal sides of each receptacle for items to be washed in each case. Alternatively, each loading level can only be assigned one retraction arrangement. In this case, a retraction arrangement is preferably provided on one longitudinal side of the respective loading level and a guide device is provided on the other longitudinal side of the loading level.

Further possible implementations of the invention also comprise non-explicitly cited combinations of features or embodiments described above or below in respect of the exemplary embodiments. Here the person skilled in the art will also add individual aspects such as improvements or amendments to the respective basic form of the invention.

BRIEF DESCRIPTION OF THE DRAWINGS

Further advantageous embodiments and aspects of the invention form the subject matter of the subclaims and the exemplary embodiments of the invention described below. The invention is described in further detail below on the basis of preferred embodiments with reference to the appended figures.

DETAILED DESCRIPTION OF EXEMPLARY EMBODIMENTS OF THE PRESENT INVENTION

Figure 1:
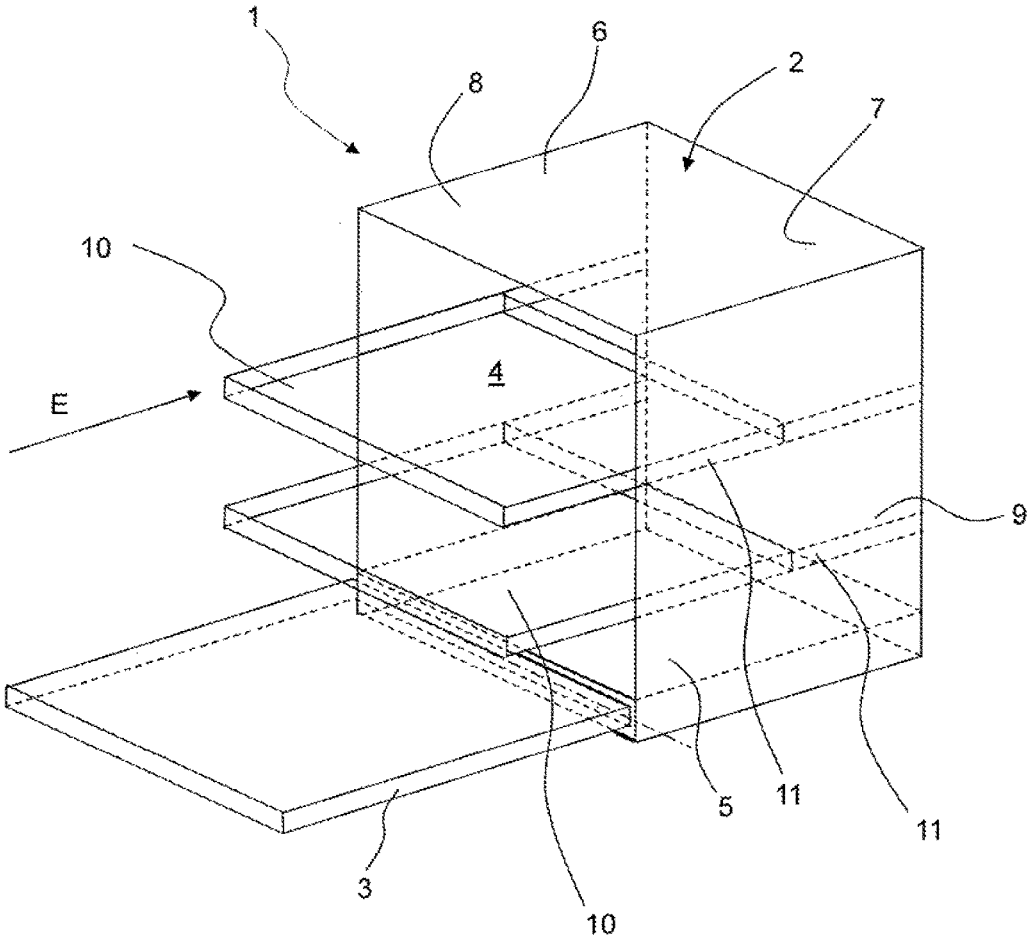
FIG. 1 shows a schematic perspective view of an embodiment of a household appliance.

Elements which are the same or function the same have been provided with the same reference characters in the figures, unless otherwise specified.

FIG. 1 shows a schematic perspective view of a household appliance 1. The household appliance 1 can be a dishwasher, a refrigerator, an upright freezer, an oven, a microwave oven or suchlike. The household appliance 1 is preferably a dishwasher. The household appliance 1 has a receiving area 2, which can be closed by a door 3, in particular in a water-tight manner The receiving area 2 is preferably a dishwasher cavity of the household appliance 1. The receiving area 2 and the door 3 can form a washing chamber 4 for washing items to be washed. The receiving area 2 can be arranged in the interior of a housing of the household appliance 1. The door 3 is shown in its open position in FIG. 1. The door 3 can be closed or opened by pivoting about a pivot axis provided on the lower end of the door 3.

The receiving area 2 has a base 5, a ceiling 6, a rear wall 7 and two opposing side walls 8, 9. The household appliance 1 further has at least one loading level 10. The loading level 10 can optionally be displaced into or out of the receiving area 2. The loading level 10 is preferably a receptacle for items to be washed of the household appliance 1. In particular, a number of loading levels 10 can be provided, wherein one of the number of loading levels 10 is a lower basket, a top basket or a cutlery drawer of the household appliance 1 in each case. The number of loading levels 10 are preferably arranged one above the other in the receiving area 2. The loading level 10 can preferably be displaced into or out of the receiving area 2 with the aid of a guide device 11.

Figure 2:
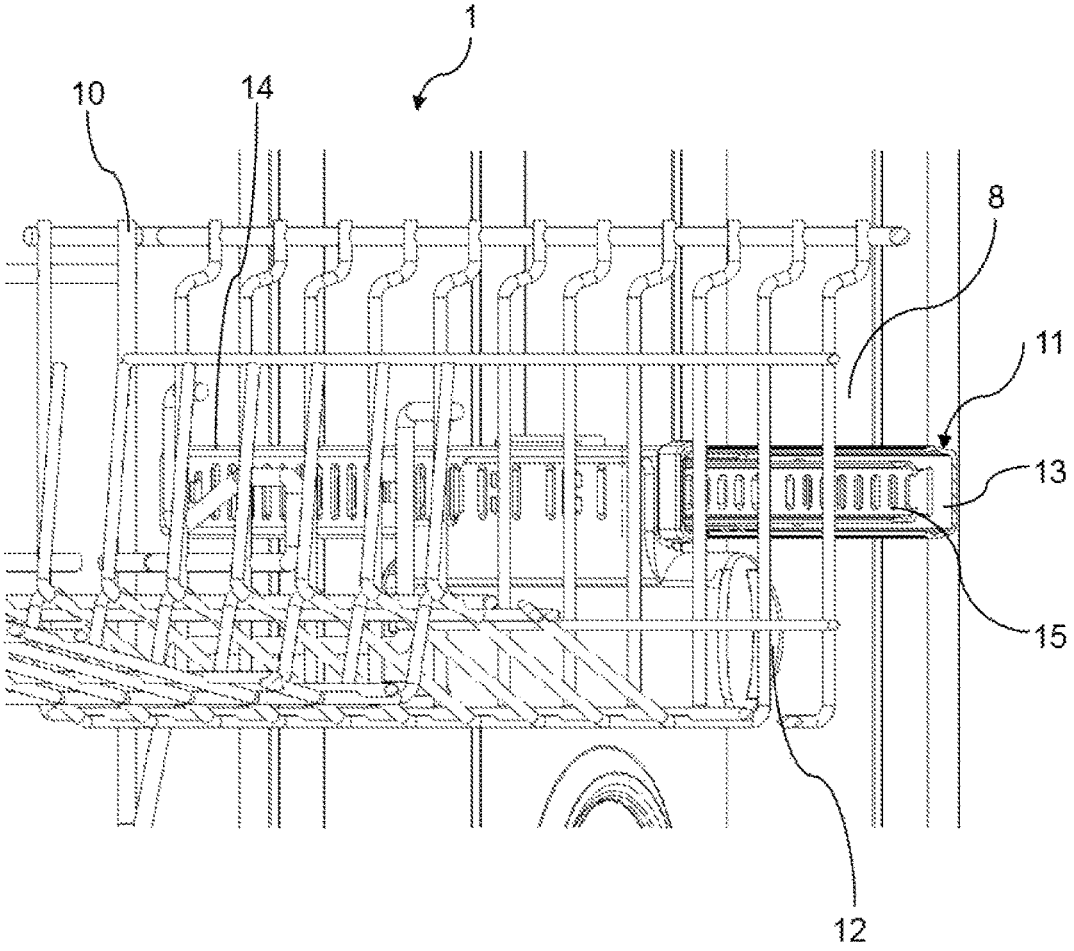
FIG. 2 shows a schematic perspective partial view according to FIG. 1.

FIG. 2 shows a schematic perspective view of a detailed view of the household appliance 1 according to FIG. 1. The household appliance 1 further comprises a retraction device 12 for automatically displacing the loading level 10 into the receiving area 2. The retraction device 12 is configured to displace the loading level 10 in a retraction direction E automatically into the receiving area 2 (FIG. 1). The guide device 11 has in particular a first guide rail 13, which is assigned to the receiving area 2. In particular, the first guide rail 13 is fixedly connected to one of the side walls 8, 9 of the receiving area 2, in particular welded, riveted or screwed thereto. Guide devices 11 which are arranged opposite to one another are preferably provided on the two side walls 8, 9. Two guide devices 11 are preferably assigned to each loading level 10.

The guide device 11 further has a second guide rail 14, which is assigned to the loading level 10. The second guide rail 14 can be connected to the loading level 10 for instance. In particular, the loading level 10 can be screwed or clipped to the second guide rail 14. The retraction device 12 is configured to automatically displace the second guide rail 14 along the first guide rail 13.

Figure 3:
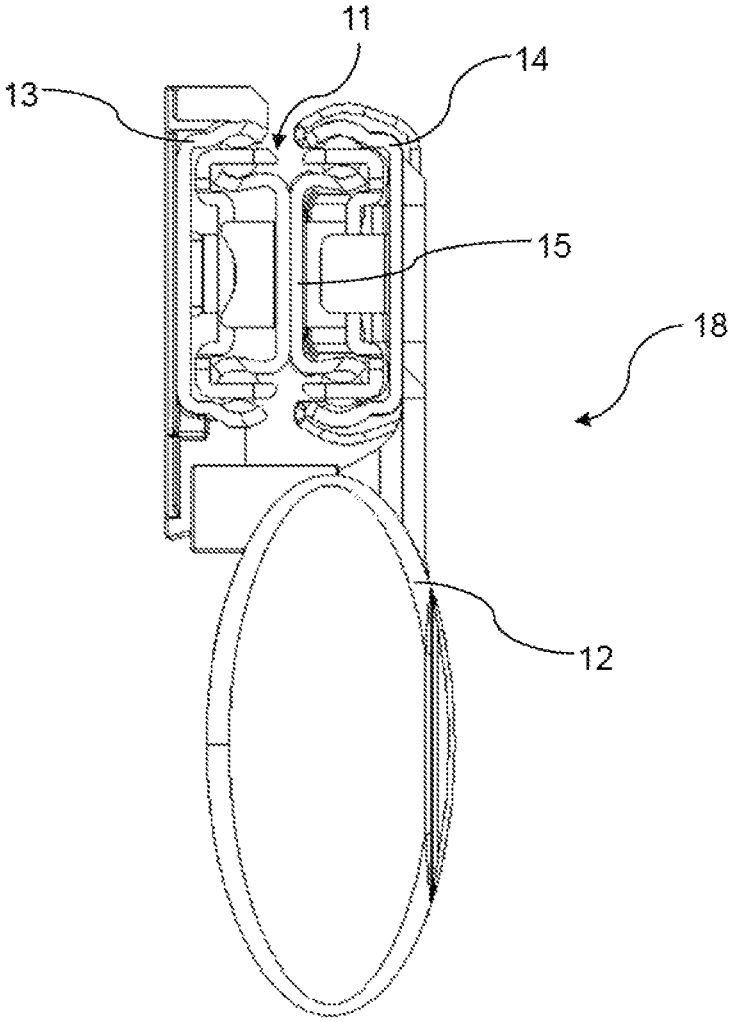
FIG. 3 shows a schematic sectional view of an embodiment of a retraction arrangement for a household appliance according to FIG. 1.

FIG. 3 shows a schematic sectional view of the guide device 11 with the guide rails 13, 14 and the retraction device 12. The guide device 11 further has a central guide rail 15 arranged between the first and the second guide rail 13, 14. The central guide rail 15 can be displaced opposite to the guide rails 13, 14.

Figure 4:
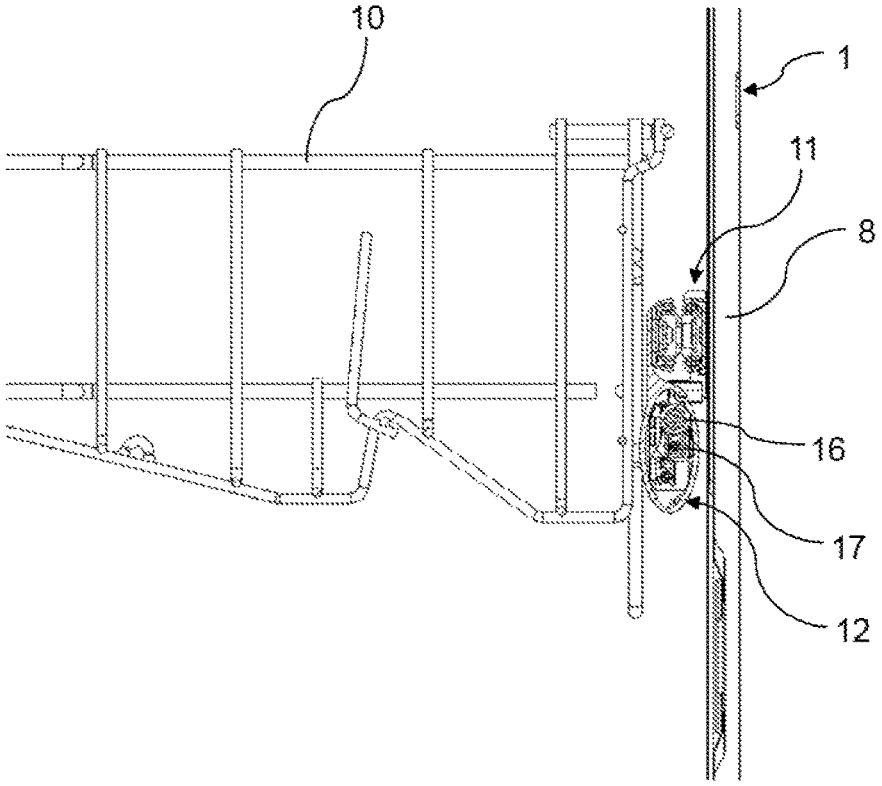
FIG. 4 shows a schematic sectional view of the household appliance according to FIG. 1.

As FIG. 4 shows, the retraction device 12 has a spring element 16, which can be prestressed when the loading level 10 is displaced out of the receiving area 2 against the retraction direction E. Furthermore, the retraction device 12 has a damping element 17, which is configured to dampen a movement of the loading level 2 when the loading level 10 is automatically displaced in the retraction direction E into the receiving area 2.

Figure 5:
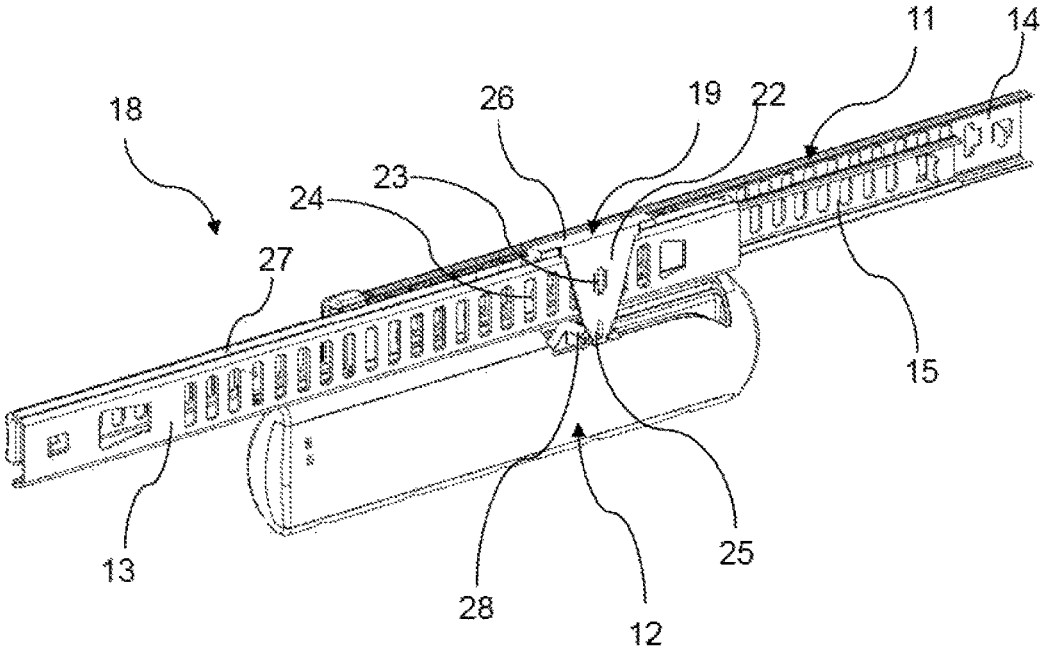
FIG. 5 shows a schematic perspective view of the retraction arrangement according to FIG. 3.
Figure 6:
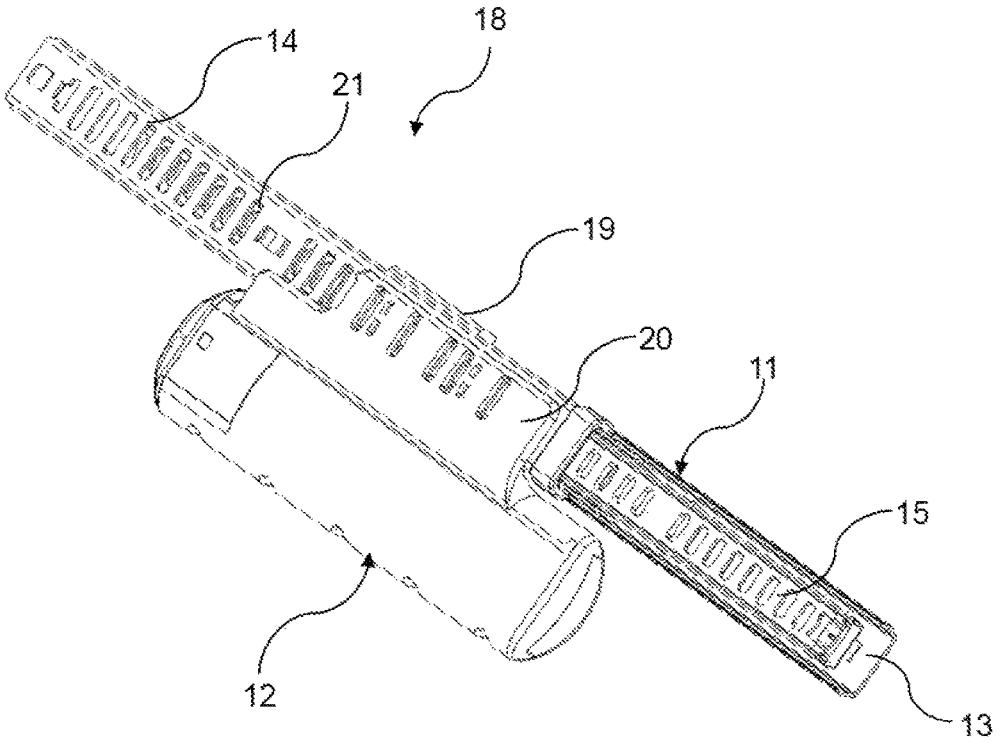
FIG. 6 shows a further schematic perspective view of the retraction arrangement according to FIG. 3.

As FIGS. 5 and 6 show in perspective schematic views, a retraction arrangement 18 comprises the guide device 11, the retraction device 12 and an activator element 19. The retraction device 12 may also comprise the activator element 19. Each loading level 10 is preferably assigned two retraction arrangements 18. Alternatively, each loading level 10 can only be assigned one retraction arrangement 18. In this case, a retraction arrangement 18 is provided on one longitudinal side of the respective loading level 10 and a guide device 11 is provided on the other longitudinal side of the loading level 10.

The retraction device 12 is connected to the second guide rail 14 of the guide device 11 with the aid of a fastening section 20. The fastening section 20 is preferably plate-shaped and can be screwed, riveted or clipped to the guide rail 14. The fastening section 20 may have snap hooks, which engage in a form-fit manner into corresponding cut-outs 21 of the guide rail 14. The guide rail 14 may have a plurality of cut-outs 21, of which only one is provided with a reference character in FIG. 6 however.

The activator element 19 is connected to the first guide rail 13. The activator element 19 is in particular a plastic injection molded part. The activator element 19 is preferably snapped or clipped into the first guide rail 13. To this end, the activator element has a triangular geometry with a fastening section 22. The fastening section 22 may have a snap hook 23, which is configured to engage in a form-fit manner in a corresponding cut-out 24 of the first guide rail 13. The guide rail 13 may have a plurality of cut-outs 24, of which only one is provided with a reference character in FIG. 5. Furthermore, the activator element 19 has a pin-type activator section 25. The activator section 25 is located on a tip of the triangular geometry of the activator element 19. The activator element 19 rests with a contact section 26 on a top side 27 of the first guide rail 13. In an alternative embodiment of the retraction arrangement 18, the retraction device 12 can be secured to the first guide rail 13 and the activator element 19 can be secured to the second guide rail 14. The retraction device 12 is thus not secured directly to the receiving area 2.

The guide device 12 has an engagement section 28, which is operatively connected to the spring element 16 and the damping element 17. The activator element 19, in particular the activator section 25, is configured to engage in a form-fit manner in the engagement section 28.

Figure 7:
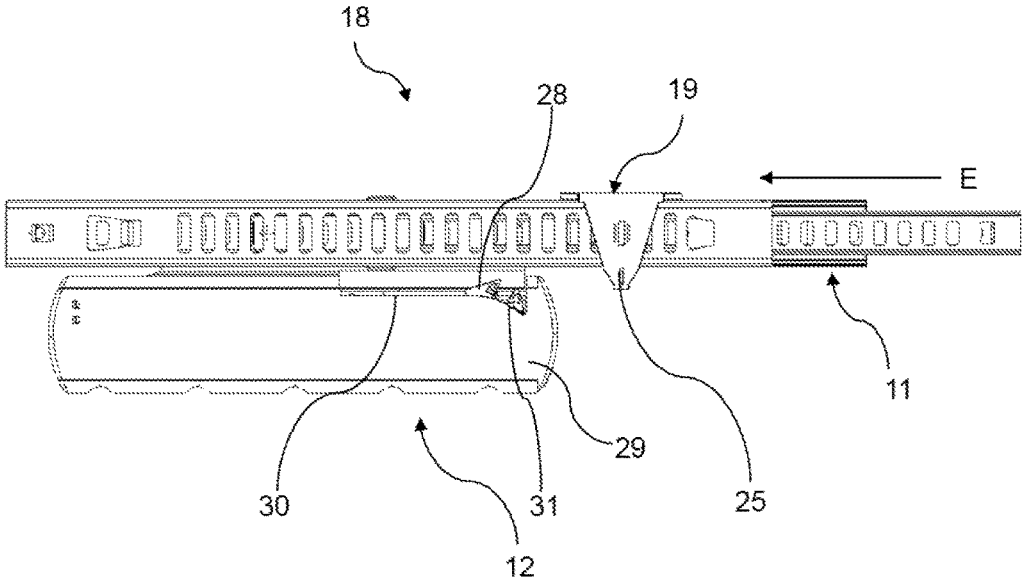
FIG. 7 shows a schematic side view of the retraction arrangement according to FIG. 3.
Figure 8:
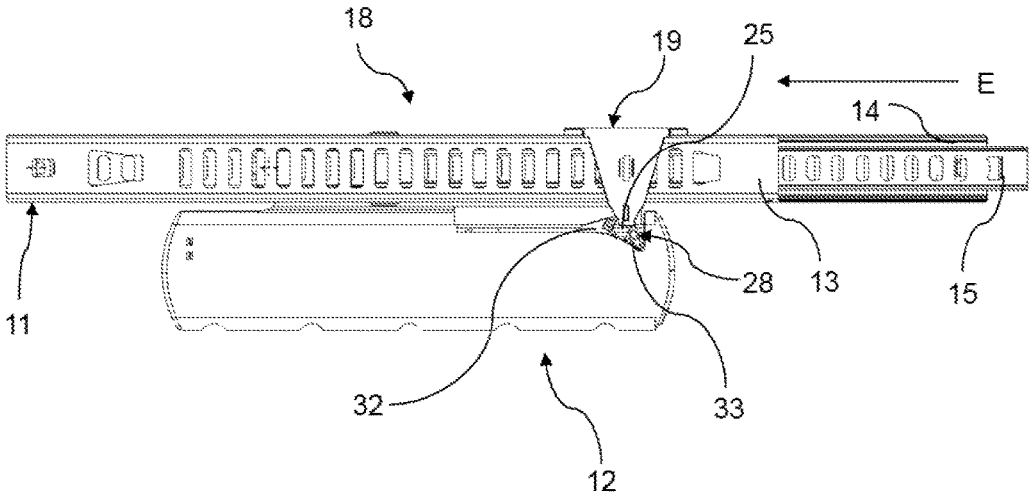
FIG. 8 shows a further schematic side view of the retraction arrangement according to FIG. 3.
Figure 9:
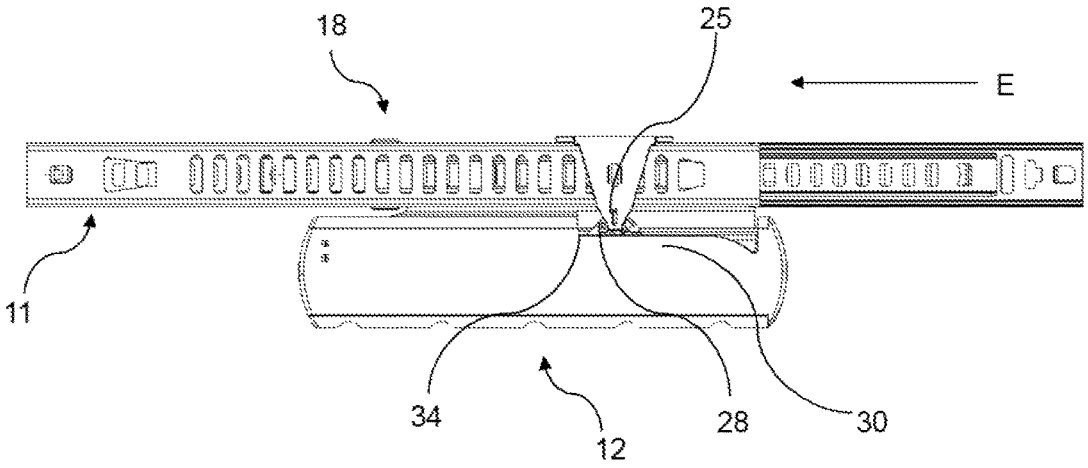
FIG. 9 shows a further schematic side view of the retraction arrangement according to FIG. 3.

The mode of operation of the retraction arrangement 18 is explained on the basis of FIGS. 7 to 9. FIGS. 7-9 each show schematic side views of the retraction arrangement 18. FIG. 7 shows the retraction arrangement 18 in a state in which the loading level 10 is displaced out of the receiving area 2 of the household appliance 1. The engagement section 28 of the retraction device 12 is located in an end position of a groove 30 provided on a housing 29 of the retraction device 12. The engagement section 28 can be moved along the groove 30. The groove 30 has a curved geometry on an end section 31. In the end position of the engagement section 28 shown in FIG. 7, this is arranged in the curved end section 31 of the groove 30 and does not engage with the activator section 25. When the loading level 10 is displaced in the retraction direction E into the receiving area 2 of the household appliance, the activator section 25 of the activator element 19 approaches the engagement section 28 of the retraction device 12.

FIG. 8 shows the retraction arrangement 18 in a state in which the activator section 25 engages precisely into the engagement section 28. The engagement section 28 to this end has two gripper arms 32, 33 which face one another and which laterally surround the activator section 25 on both sides. As shown in FIG. 8, the activator element 25 firstly moves against the gripper arm 32 of the engagement section 28 when the loading plane 10 is displaced into the receiving area 2 in the retraction direction E. The prestressed spring element 16, which is prestressed against the retraction direction E when the loading level 10 is pulled out, is unlocked here. The engagement section 28 automatically moves along the groove 30 in the retraction direction E and takes the activator element 19, which is fixedly connected to the guide rail 13, with it. Here the loading level 10 automatically displaces in the retraction direction E into the receiving area 2 of the household appliance 1.

FIG. 9 shows the retraction arrangement 18 in an end position. Here the engagement section 28 in the retraction direction E is moved to a second end section 34 of the groove 30. When the loading level 10 is moved into the end position shown in FIG. 9, the damping element 17 dampens the movement of the loading level 10. A uniform and smooth entry of the loading level 10 into the receiving area 2 is always ensured in this way.

Although the present invention was described on the basis of exemplary embodiments, it can be modified in a variety of ways.

REFERENCE CHARACTERS USED

1 household appliance
2 receiving area
3 door
4 washing chamber
5 base
6 ceiling
7 rear wall
8 side wall
9 side wall
10 loading level
11 guide device
12 retraction device
13 guide rail
14 guide rail
15 guide rail
16 spring element
17 damping element
18 retraction arrangement
19 activator element
20 securing section
21 cut-out
22 securing section
23 snap hook

24 cut-out
25 activator section
26 contact section
27 top side
28 engagement section
29 housing
30 groove
31 end section
32 gripper arm
33 gripper arm
34 end section
E retraction direction

The invention claimed is:

1. A household appliance, comprising a loading level;

a receiving area for receiving the loading level;

a guide rail assembly configured to guide the loading level when the loading level is selectively displaced into or out of the receiving area along the guide rail assembly;

a retractor secured to the guide rail assembly and configured to automatically displace the loading level into the receiving area; and an activator arm configured to engage in a form-fit manner in an engagement section of the retractor, wherein the guide rail assembly comprises a fixed guide rail, which is fixed to the receiving area, and at least one movable guide rail, which is fixed to the loading level, said retractor configured to automatically displace the at least one movable guide rail along the fixed guide rail, wherein the retractor includes a plate-shaped fastening section which is directly fixed to the at least one movable guide rail, wherein the plate-shaped fastening section includes at least one snap hook which engages in a form-fit manner into at least one corresponding cut-out of the at least one movable guide rail, wherein the activator arm is fixed to the fixed guide rail of the guide rail assembly, and wherein the activator arm has a contact section that rests on a top side of the fixed guide rail, and a triangular extension plate with a securing section configured to engage the fixed guide rail and a pin-type activator section located on a tip of the triangular extension plate.

2. The household appliance of claim 1, constructed in the form of a dishwasher.

3. The household appliance of claim 1, wherein the retractor includes a spring element, which is maintained under tension, when the loading level is displaced out of the receiving area.

4. The household appliance of claim 1, wherein the retractor has a dampener configured to dampen a movement of the loading level while automatically displacing the loading level into the receiving area.

5. The household appliance of claim 1, wherein the retractor, the guide rail assembly and the activator arm form a retraction arrangement of the household appliance.

6. The household appliance of claim 1, wherein the activator arm engages into the engagement section, when the loading level and the retractor are displaced in a retraction direction, to thereby enable activation of the retractor to automatically displace the loading level into the receiving area.

7. The household appliance of claim 1, wherein the activator arm is a plastic injection molded part.

8. The household appliance of claim 1, wherein the activator arm is configured to snap into the fixed guide rail of the guide rail assembly.

9. The household appliance of claim 1, wherein the receiving area is a dishwasher cavity.

10. The household appliance of claim 1, wherein the loading level is a receptacle for items to be washed.

11. The household appliance of claim 10, further comprising a plurality of said receptacle, each said receptacle being configured as a bottom basket, a top basket or a cutlery drawer.

12. The household appliance of claim 1, wherein the at least one snap hook comprises a plurality of snap hooks which engage in a form-fit manner into a plurality of corresponding cut-outs of the at least one movable guide rail.

* * * * *